US006906609B1

(12) United States Patent
Piechnick

(10) Patent No.: US 6,906,609 B1
(45) Date of Patent: Jun. 14, 2005

(54) PLANAR TRANSFORMER

(75) Inventor: John Piechnick, Pasig (PH)

(73) Assignee: Astec International Limited, Kwun Tong (HK)

( * ) Notice: Subject to any disclaimer, the term of this patent is extended or adjusted under 35 U.S.C. 154(b) by 0 days.

(21) Appl. No.: 09/545,367

(22) Filed: Apr. 7, 2000

(51) Int. Cl.[7] ..... H01F 27/30
(52) U.S. Cl. ..... 336/198
(58) Field of Search ..... 336/65, 90, 98, 336/192, 198, 196, 199, 84 C

(56) References Cited

U.S. PATENT DOCUMENTS

| | | | | |
|---|---|---|---|---|
| 3,750,072 A | | 7/1973 | Weiner | 336/185 |
| 4,000,483 A | * | 12/1976 | Cook et al. | 336/98 |
| 4,405,913 A | | 9/1983 | Finkbeiner | 336/98 |
| 4,549,130 A | * | 10/1985 | Dobberstein | 336/82 |
| 4,596,974 A | * | 6/1986 | Tobben et al. | 336/198 |
| 4,716,394 A | | 12/1987 | Gordon | 336/192 |
| 4,857,878 A | * | 8/1989 | Eng, Jr. et al. | 336/192 |
| 4,939,623 A | * | 7/1990 | Equi et al. | 336/65 |
| 4,980,664 A | | 12/1990 | Harwood | 336/192 |
| 4,988,968 A | | 1/1991 | Tochio et al. | 336/98 |
| 5,010,314 A | * | 4/1991 | Estrov | 336/198 |
| 5,321,572 A | | 6/1994 | Shibui et al. | 361/38 |
| 5,726,616 A | | 3/1998 | Bell | 336/92 |
| 5,783,982 A | | 7/1998 | Lecheler | 336/9 |
| 5,996,214 A | | 12/1999 | Bell | 29/605 |
| 6,008,712 A | | 12/1999 | Tokuda et al. | 336/198 |

FOREIGN PATENT DOCUMENTS

| | | | |
|---|---|---|---|
| EP | 0 933 789 | * | 8/1999 |

* cited by examiner

*Primary Examiner*—Tuyen T. Nguyen
(74) *Attorney, Agent, or Firm*—Coudert Brothers LLP

(57) ABSTRACT

A transformer having at least one primary winding and one secondary winding. The windings are disposed between walls of a first and second bobbin member. In preferred eombodiments, the creepage distance between the windings can be increased by providing a flange on one of the walls of one of the bobbin members.

1 Claim, 9 Drawing Sheets

SECTION A'-A'

SECTION A"-A"

PLANAR TRANSFORMER

FIELD OF THE INVENTION

Embodiments of the invention relate to transformers and transformer assemblies.

BACKGROUND OF THE INVENTION

Small switch mode AC/DC power supplies or adapters are now starting to replace 50/60 Hz transformer "linear" adapters. They are lighter, smaller, and are cost competitive with the "linear" adapters. One of the main areas of use for these adapters is as battery chargers for GSM and other types of cellular telephones. With the standby power consumption of these telephones getting continuously lower, the battery sizes for these telephones are also getting smaller. A two-watt adapter charger is adequate for charging such a battery in only a few hours.

Because of the very low cost of the linear chargers, only the lowest cost "switching" topology is capable of competing in terms of cost. This topology is usually a self-oscillating fly back converter using a high voltage bipolar transistor as a main switch. FIG. 18 shows a functional diagram of a typical self-oscillating converter.

The transformer is both a costly and physically large part of a power supply. The large size is due in part to the safety creepage and clearances required between the primary and secondary windings of the transformer. Creepage and clearance distances are a significant factor in determining the physical size of the transformer. While triple insulation on the secondary wire can be used to keep the size of the transformer small, the use of triple insulation is expensive. The concentric winding arrangement of the transformer's windings also results in high common mode EMI, which usually requires an electrostatic shield winding and a common mode filter capacitor.

Embodiments of the invention address these and other problems.

SUMMARY OF THE INVENTION

Embodiments of the invention are directed to transformers and transformer assemblies, especially planar transformers for small switch-mode isolated adapters.

One embodiment of the invention is directed to a transformer having at least one primary winding and one secondary winding wound about a common axis comprising: a first bobbin member including a first body portion defining a first hollow region, and axially spaced walls extending radially away from the first body portion; and a second bobbin member including a second body portion defining a second hollow region, axially spaced walls extending radially away from the second body portion, and a flange on one of said axially spaced walls and extending away from the other axial spaced wall of the second bobbin member; and wherein the first bobbin member is disposed adjacent to the second bobbin member and is partially enclosed by the flange, said primary and secondary windings respectively wound about said first and second body portions.

An alternative embodiment of the invention is directed to a transformer having at least one primary winding and one secondary winding wound about a common axis comprising: a first bobbin member including a first body portion defining a first hollow region, axially spaced walls extending radially away from the first body portion, and a structure adapted to receive a printed circuit board (PCB) so that the printed circuit board is disposed parallel to the walls of the first bobbin member; and a second bobbin member including a second body portion defining a second hollow region which is aligned with the first hollow region, and axially spaced walls extending radially away from the second body portion, wherein the first bobbin member is disposed adjacent to the second bobbin member, the primary and secondary windings respectively wound about said first and second body portions.

These and other embodiments are described with reference to the foregoing Figures and Detailed Description

BRIEF DESCRIPTION OF THE DRAWINGS

FIG. 10 shows one example of cooperatively arranged structures in a transformer to, e.g., increase creepage distance.

For clarity of illustration, some drawings may not be to scale. Also, in the Figures, like numerals are intended to designate like elements.

DETAILED DESCRIPTION

The transformers according to embodiments of the invention are smaller and have a lower profile than many conventional transformers, and meet or exceed the safety and creepage requirements of many countries. The height of a transformer, in particular, is an important factor to consider when designing a device such as cellular phone charger.

Figure 1:
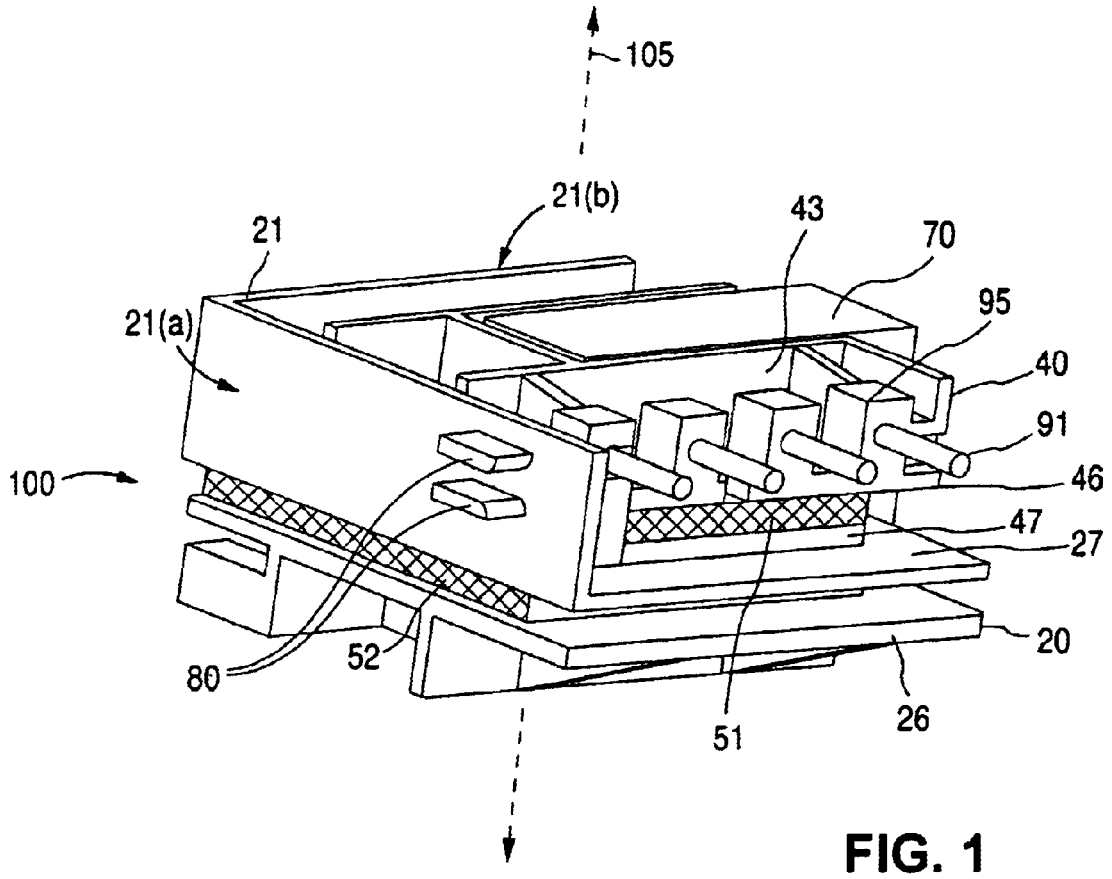
FIGS. 1 to 3 show different isometric views of a transformer according to an embodiment of the invention.

FIG. 1 shows a transformer 100 including a first bobbin member 40 and a second bobbin member 20 including at least a primary and secondary winding. The first and second bobbin members 40, 20 are adjacent to each other, and are coupled together. In some embodiments, the second bobbin member 20 may occupy a larger area than the first bobbin member 40. As shown in FIG. 1, the first bobbin member 40 may be disposed on and may be partially enclosed by the second bobbin member 20. Both the first and second bobbin members 40, 20 may include portions formed from molded plastic.

Any suitable wiring, such as enameled copper wiring, may be used for the windings. Moreover, any suitable number of windings may be present on the first or the second body portions of the first and second bobbin members. For example, an auxiliary winding may be provided over or under the primary winding such that it is closest to a transistor collector end of the winding. This winding further shields the noisiest end of the primary winding.

The first bobbin member 40 comprises a first body portion (not shown) having a hollow region. Walls 46, 47 on respective ends of the first body portion partially define a winding region for at least one winding. For example, a winding 51 (e.g., a primary winding) is disposed between the walls 46, 47 and around the first body portion. Both the winding 51 and the first body portion upon which it rests are disposed around an axis 105. The walls 46, 47 are axially spaced from each other and extend in a radial direction away from the first body portion. A number of pins 91 may be present in a number of pin supports 95, which may be integral with a wall 46 of the first bobbin member 40. Each of the pins 91 may be in communication with one or more windings 51 disposed around the first body portion. Wires may pass through slots between the pin supports 95. The pins 91 may be used to couple the transformer 100 to an external electrical device such as a printed circuit board.

The second bobbin member 20 comprises a second body portion (not shown) having a hollow region. The second body portion is disposed between walls 26, 27 which, along with the exterior surface of the second body portion, define a winding region for at least one winding. The winding 52 on the second body portion (e.g., a secondary winding) is disposed between the walls 26, 27 of the second bobbin member 20 and around the second body portion. The winding 52 and the hollow body portion are both disposed around the axis 105. The walls 26, 27 of the second bobbin member 20 are axially spaced from each other and extend in a radial direction away from the hollow body portion. As shown in FIG. 1, the walls 26, 27 of the second bobbin member 20 may have a larger major surface area than the walls 46, 47 of the first bobbin member 40.

A flange 21 is disposed on one wall 27 of the second bobbin member 20 and may extend in a direction away from the other wall 26 of the second bobbin member 20. The flange 21 may be located at any suitable region on the wall 27 of the second bobbin member 20. For example, the flange 21 can be at the side of the transformer 100 opposite the outer leg of the core 70. Preferably, the flange 21 is located at the edges of the wall 27 (e.g., an inner wall) upon which it is disposed. In the transformer 100 shown in FIG. 1, the flange 21 includes two flange portions 21(*a*), 21(*b*). The flange portions 21(*a*), 21(*b*) are substantially perpendicular to each other and each is perpendicular to the walls 26, 27.

The flange 21 advantageously increases the creepage distance between the two windings 51, 52 at regions of the transformer 100. Lengthening the creepage path (i.e., the path across the surface of a dielectric between two conductors) reduces the possibility of damage due to, e.g., arcing between the windings on the first and second bobbin members 40, 20. In the transformer 100 shown in FIG. 1, for example, the creepage path begins at the winding 52 on the second bobbin member 20, passes outwardly across the lower surface of the wall 27, up the face of the flange portion 21(*a*), down the opposite face of the flange portion 21(*a*), across the upper surface of the wall 27, and to the coil 51 on the first bobbin member 40. In embodiments of the invention, the creepage distance can be increased without increasing the length or width of the walls of the first and second bobbin members 40, 20.

Optionally, the transformer embodiments may include one or more structures for receiving a circuit board (not shown). The circuit boards can be mounted using the structures so that the mounted boards are disposed generally parallel to the walls of the bobbin members 20, 40. In FIG. 1, for example, a structure 80 for receiving a circuit board is present on the flange 21. This structure 80 includes two protrusions extending away from an outer surface of one of the flange portions 21(*a*). When a circuit board is mounted to the flange portion 21(*a*), the circuit board is sandwiched between the protrusions and is parallel to the walls 26, 27, 46, 47 of the bobbin members 20, 40.

A core 70 such as a ferrite core passes through the first and second hollow portions of the first and second bobbin members 40, 20. The core 70 may be formed from portions having any suitable shape. For example, the core 70 may be formed by using two U-shaped core portions 4 coupled together to form a ring. Alternatively, the core 70 may be formed by coupling a U-shaped core portion and an I-shaped bar to form a ring. The core may also be formed from E-shaped core portions. For example, the core 70 may include two E type core portions coupled together or an E and an I type core coupled together.

The core 70 may have a potential which is between (e.g., halfway between) the potentials of the windings 51, 52 on the first and second bobbin members 40, 20. In preferred embodiments, the first and second bobbin members 40, 20 may also include additional flanges to increase the creepage distance between the core 70 and the windings 51, 52 on respective bobbin members 40, 20. For example, the first bobbin member 40 may include a flange 43 which increases the creepage distance between the winding 51 on the first bobbin member 40, and the core 70. In this example, the flange 43 may have a number of flange portions and these flange portions may be closely adjacent the core 70 to shield portions of the core 70 from the winding 51. Preferably, the flange 43 conforms to the outer surface of the core 70. In the example shown in FIG. 1, the flange portions are on a wall 46 of the first bobbin member 40 and are perpendicular to the wall 46.

Preferably, as shown in FIG. 1, a flange portion 21(*b*) of the second bobbin member can extend beyond the back of the winding (e.g., a primary winding) 51 on the first bobbin member 40. Alternatively or additionally, a flange portion 21(*a*) of the second bobbin member can extend beyond the side of the winding 51. Extra creepage distance is provided by these flange portions and the transformer height can be reduced. If desired, the creepage distance between elements in the transformer may be increased in other ways. For example, the walls of the first and second bobbin members can be made wider to increase the creepage distance between respective windings on the first and second bobbin members 40, 20. In another example, additional flanges may be present on the walls of the bobbin members. For example, flanges may be on the outer walls 26, 46 of the first and second bobbin members 40, 20 at the core side of the transformer on either or both sides of the core 70. This could result in a slight increase in the height of the core, but can make the transformer narrower. This may be particularly useful for EE or EI type cores.

Figure 2:
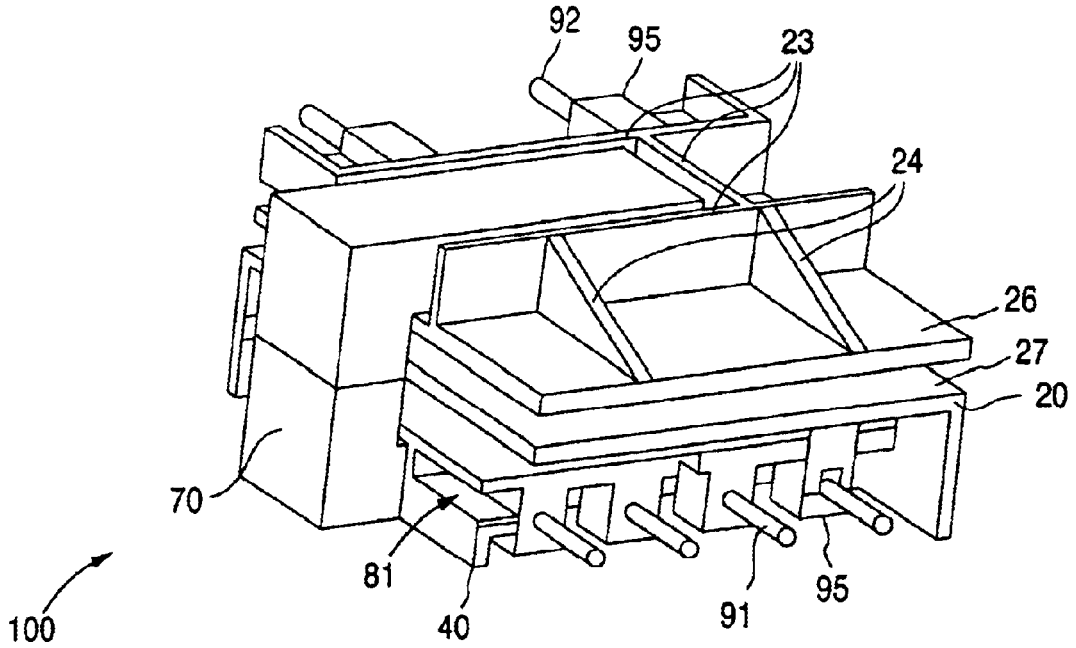

FIG. 2 shows another view of the transformer 100. In FIG. 2, the outer surface of the second bobbin member 20 is shown more clearly. The second bobbin member 20 includes pins 92 which are electrically coupled to the winding on the second bobbin member 20. A flange 23 may be present on the outer wall 26 of the second bobbin member 20. The flange 23 may be disposed adjacent to the core 70 to increase the creepage distance between the winding on the second bobbin member 20 and the core 70. Ribs 24 may be present to provide structural support for the flange 23 disposed around the core 70. The ribs 24 also increase the creepage distance between the windings on the first and second bobbin members 40, 20, especially the portions of the windings exposed by the slots between the pin supports 95. In this example, the first bobbin member 40 may include a recess 81 (e.g., a slot) for receiving a printed circuit board.

Figure 3:
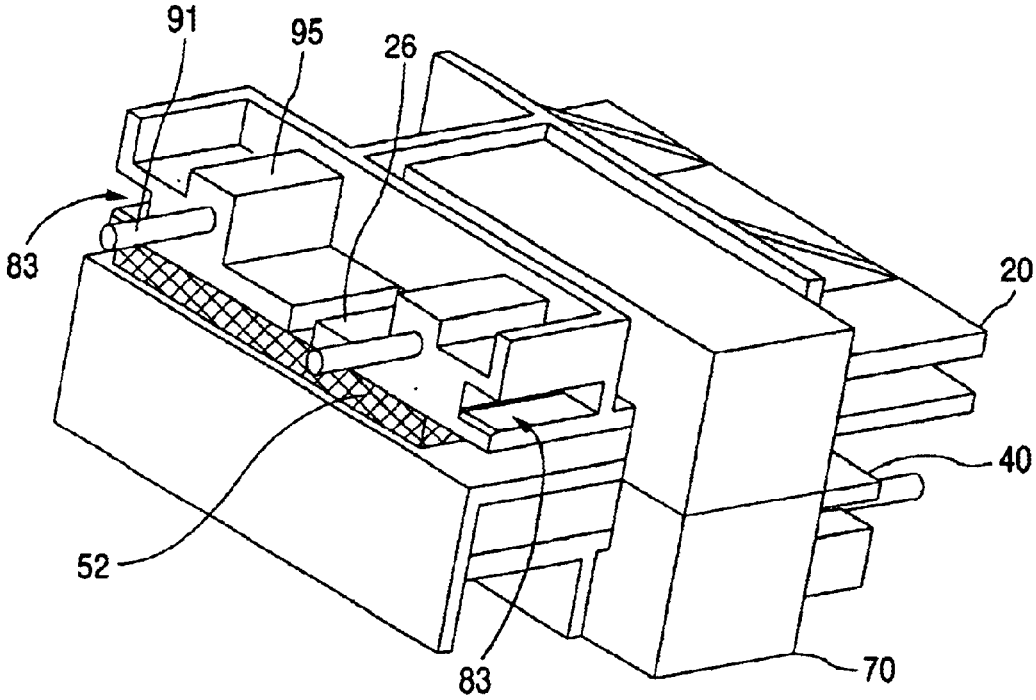

FIG. 3 shows yet another view of the transformer 100. In FIG. 3, the winding 52 on the second bobbin member 20 is shown more clearly. In this embodiment, a slot 26 is provided between two pin supports 95. The slot 26 allows the wire used for the winding 52 to start near the body portion of the bobbin member. Similar slots may be present on the first bobbin member. Also, as shown in FIG. 23, the second bobbin member 20 includes a recessed structure 83 for receiving a side-mounted printed circuit board (not shown). The recessed structure 83 is at a corner region of the second bobbin member 20.

Figure 4:
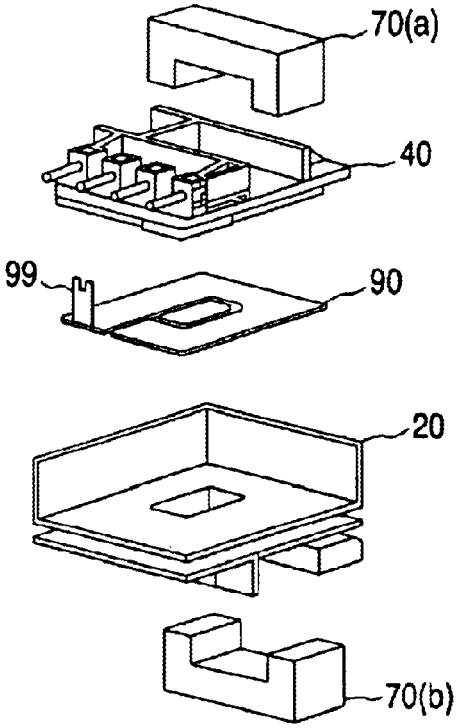
FIG. 4 is an exploded isometric view of a transformer according to an embodiment of the invention.
Figure 5:
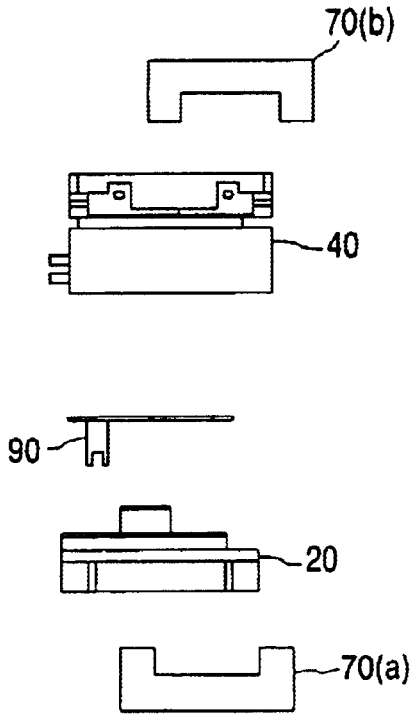
FIG. 5 is an exposed side view of a transformer according to an embodiment of the invention.
Figure 6A:
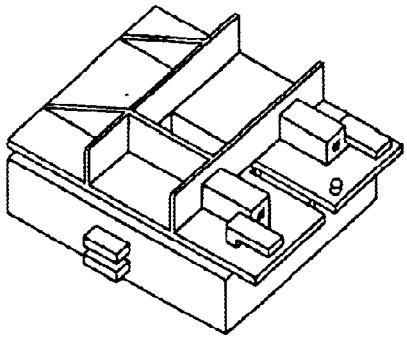
FIGS. 6(*a*) to 6(*h*), 7, and 8(*a*) to 8(*h*) show various views of exemplary bobbin members according to an embodiment of the invention.
Figure 6B:
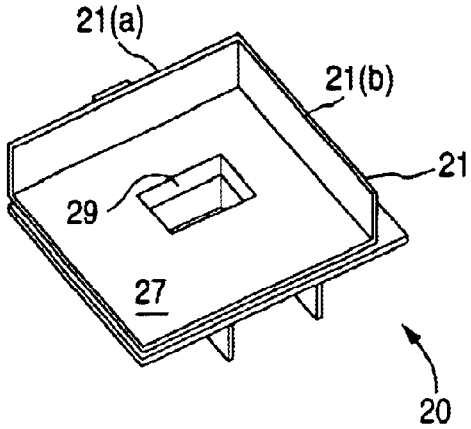
Figure 6C:
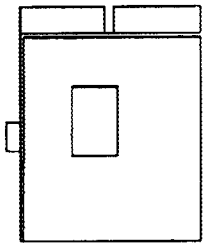
Figure 6D:
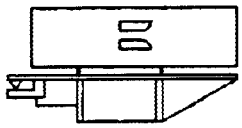
Figure 6E:
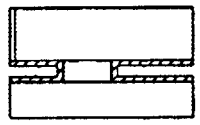
Figure 6F:
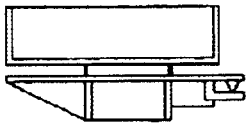
Figure 6G:
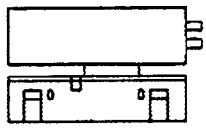
Figure 6H:
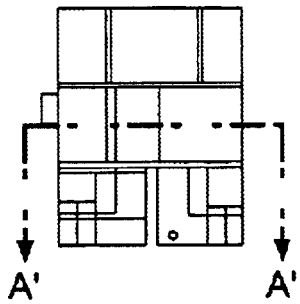
Figure 17:
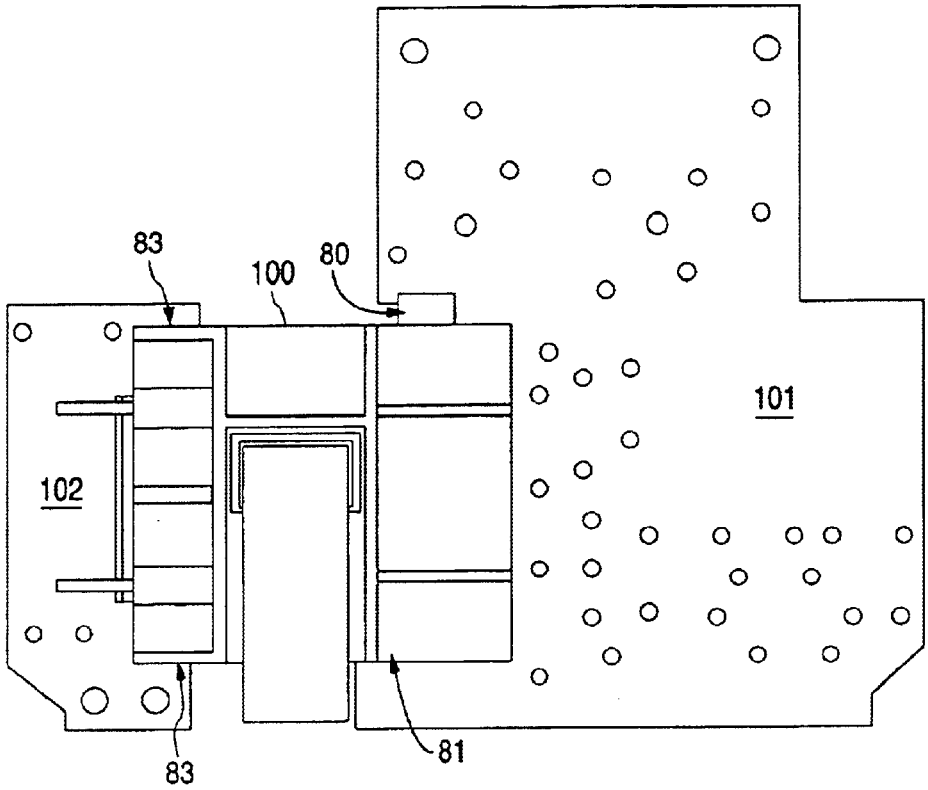
FIG. 17 is a top view of a transformer disposed between two circuit boards.
Figure 18:
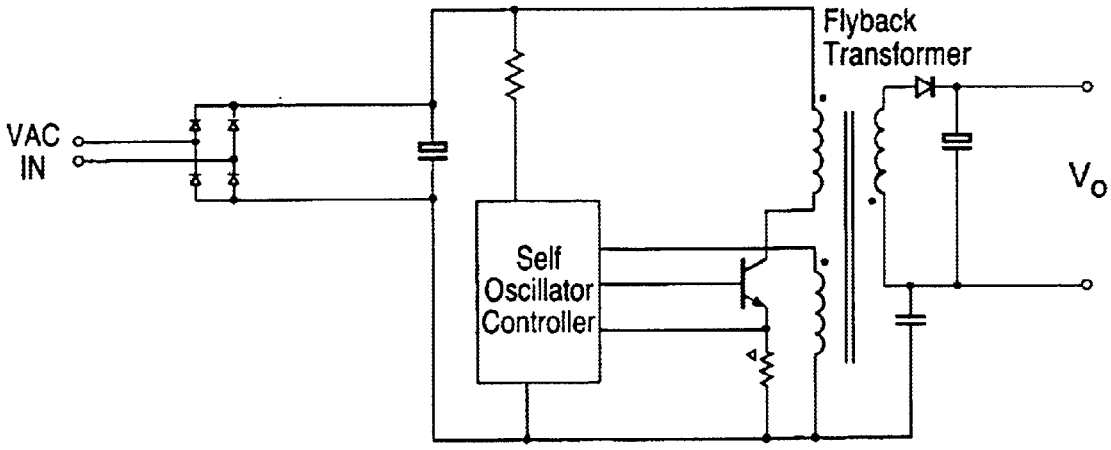
FIG. 18 is a circuit diagram including a flyback transformer.

FIGS. 4 and 5 show exploded views of a preferred transformer embodiment. As shown in these Figures, a conductive layer 90 may optionally be provided between the first and second bobbin members 40, 20 of the taansformer 100 before they are fitted together. The conductive layer 90 can be in the form of a ring and may be a Faraday shield. Typically, the conductive layer 90 comprises a flat copper shield. The conductive layer 90 may include a tab 99, which may be bent over and may be electrically coupled to one of the pins (e.g., a ground pin) on the first bobbin member 40. Conductive charge can be removed from the region between the windings of the first and second bobbin members by using the conductive layer 90. Charge can pass to the conductive layer 90, through the tab 99 and to a pin coupled to the tab 99. Advantageously, the thickness of the walls of the first and second bobbin members 40, 20 can be reduced by using the conductive layer 90 between the bobbin members 40, 20. Minimizing the wall thickness reduces any undesirable leakage inductance between the windings on the first and second bobbin members. Also, by minimizing the wall thickness, the height of the resulting transformer 100 can be reduced. The design also allows for the removal of a Y-capacitor (see e.g., FIG. 17) which might otherwise be needed. This is because the common mode EMI is significantly reduced by the presence of the EMI shield.

With reference to FIGS. 4 and 5, the core 70 may include two core portions 70(*a*), 70(*b*). In this example, both core portions 70(*a*), 70(*b*) are U-shaped. When the ends of the U-shaped core portions are joined together, they form a ring. One end of the ring passes through hollow portions in the first and second bobbin members 40, 20, while the other end of the ring is outside of the first and second bobbin members 40, 20.

FIGS. 6(*a*) to 6(*h*) show various views of an exemplary second bobbin member 20. Many of the elements shown in FIGS. 6(*a*) to 6(*h*) are already described above. However, FIG. 6(*b*) more clearly shows the second body portion 29 including a second hollow portion. The second body portion 29 is disposed between two walls 26, 27. A flange 21 including perpendicular flange portions 21(*a*), 21(*b*) is at an outer edge of one of the walls 27 and extends away from the other wall 26. In this example, the flange 21 is substantially perpendicular to the orientation of the walls 26, 27.

Figure 7:
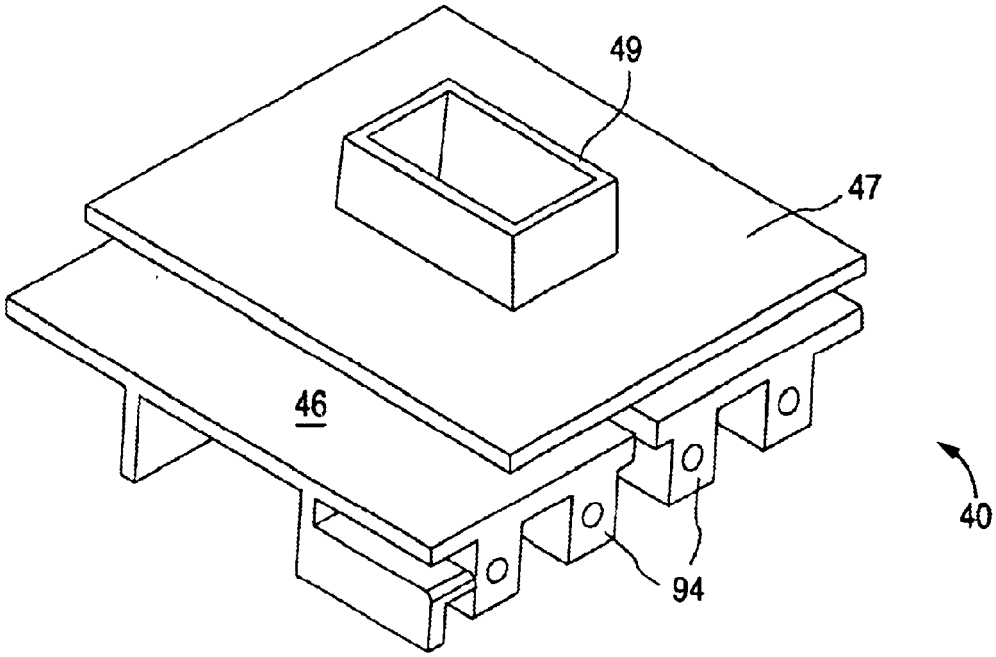

The second body portion 29 is preferably adapted to receive, and is preferably cooperatively arranged with, a tubular portion 49 on the first bobbin member 40 (see FIG. 7). For example, the second body portion 29 may be, for example, in the form of a cylinder which has a wider diameter than a cylindrical tubular portion 49. The tubular portion 49 of the first bobbin member 40 can be inserted within the hollow region of the second body portion 29 so that the first and the second bobbin members 40, 20 are coupled together. Advantageously, the first and the second bobbin members 40, 20 may be coupled together without the need to use a shroud to hold the first and second bobbin members together. Since a shroud can be excluded in preferred embodiments of the invention, the size of the transformer can be reduced by the space which might otherwise be taken up by the shroud. Moreover, the tubular portion 49 can increase the creepage distance between a conductive layer (e.g., a Faraday shield) between the first and second bobbin members, and the core passing through the bobbin member.

The tubular portion 49 shown in FIG. 7 has a rectangular cross-section. However, it is understood that the tubular portion 49 can have any suitable cross-sectional shape including a circular or square cross-section. The tubular portion 49 includes a hollow region through which a core (not shown) passes.

Figure 9:
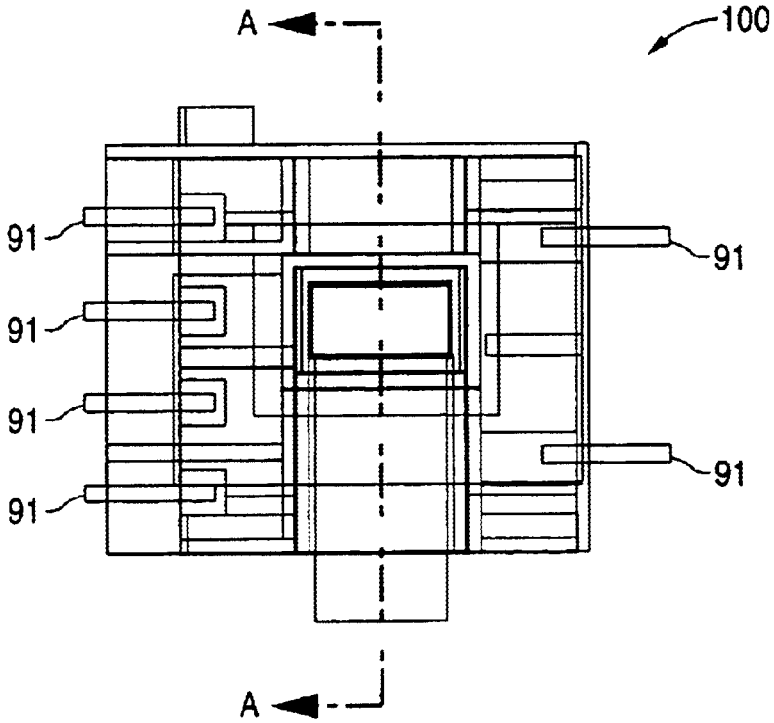
FIG. 9 shows a top view of a transformer according to an embodiment of the invention.
Figure 8A:
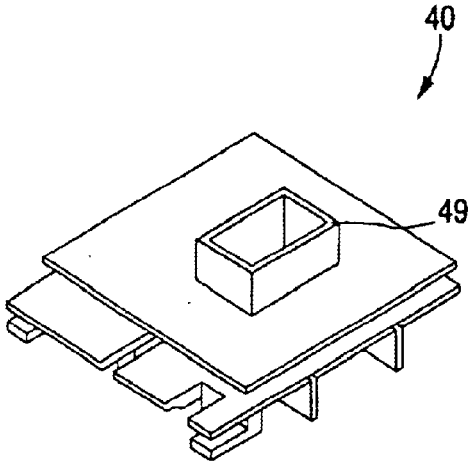
Figure 8B:
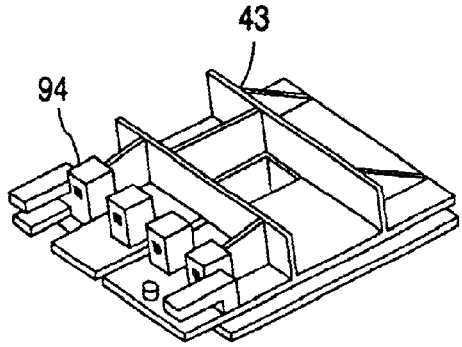
Figure 8C:
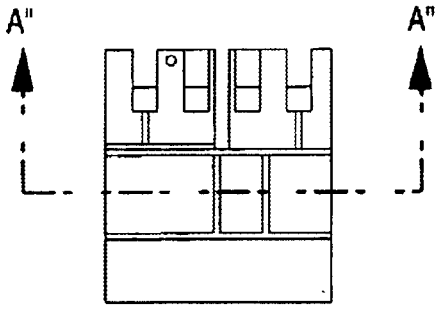
Figure 8D:
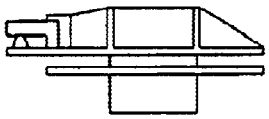
Figure 8E:
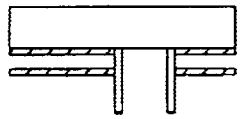
Figure 8F:
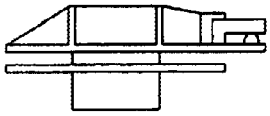
Figure 8G:
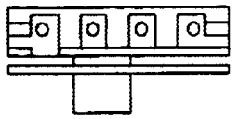
Figure 8H:
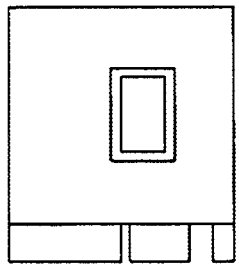

Exemplary pin supports 94 are more clearly shown in FIG. 7. The pin supports 94 may be provided to support to a plurality of pins (not shown). The pins may be inserted through holes in the individual pin supports. For instance, as shown in FIG. 9, four pins are disposed to one side of the transformer 100, while two pins may be disposed on the other side of the transformer 100. Of course, the number of pins shown is for illustration purposes and the transformer 100 may include any suitable number of pins. Various views of a first bobbin member 40 are shown in FIGS. 8(*a*) to 8(*h*). Many of the elements shown in these Figures are described in detail above.

Figure 10:
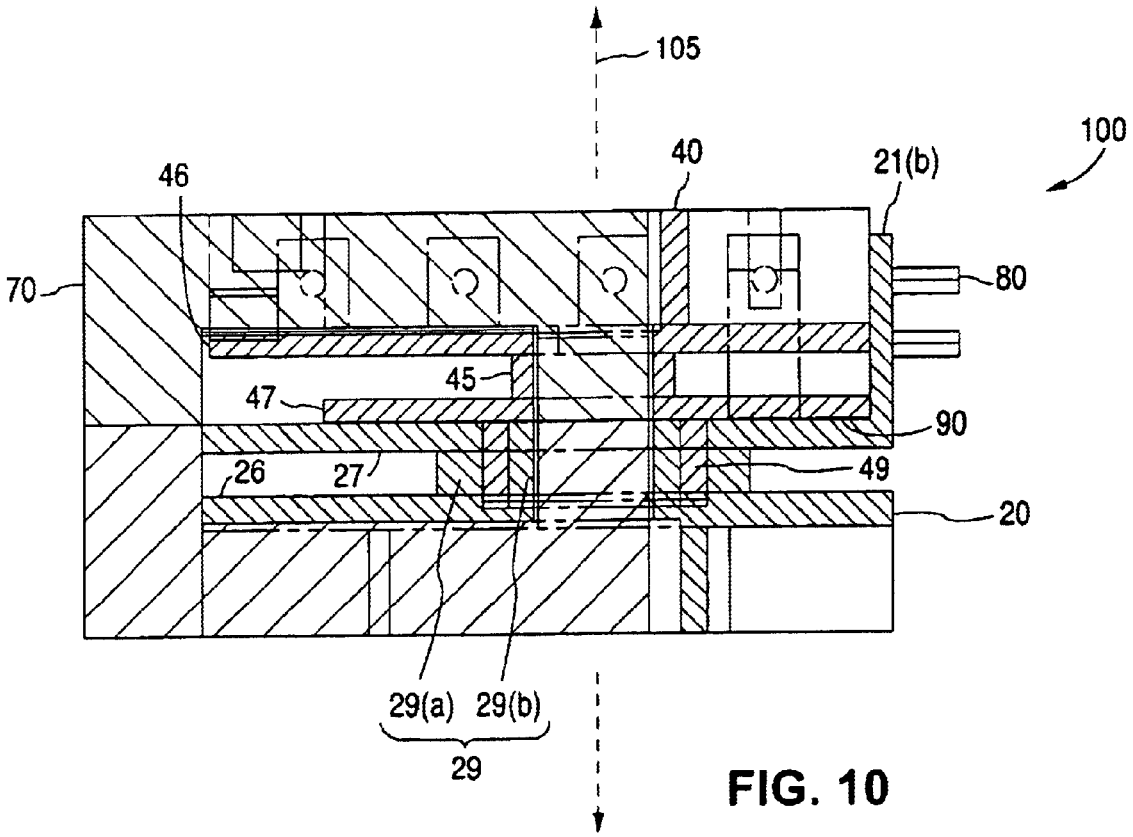
FIG. 10 is a cross-sectional view along the line A—A of the transformer shown in FIG. 9.
Figure 11:
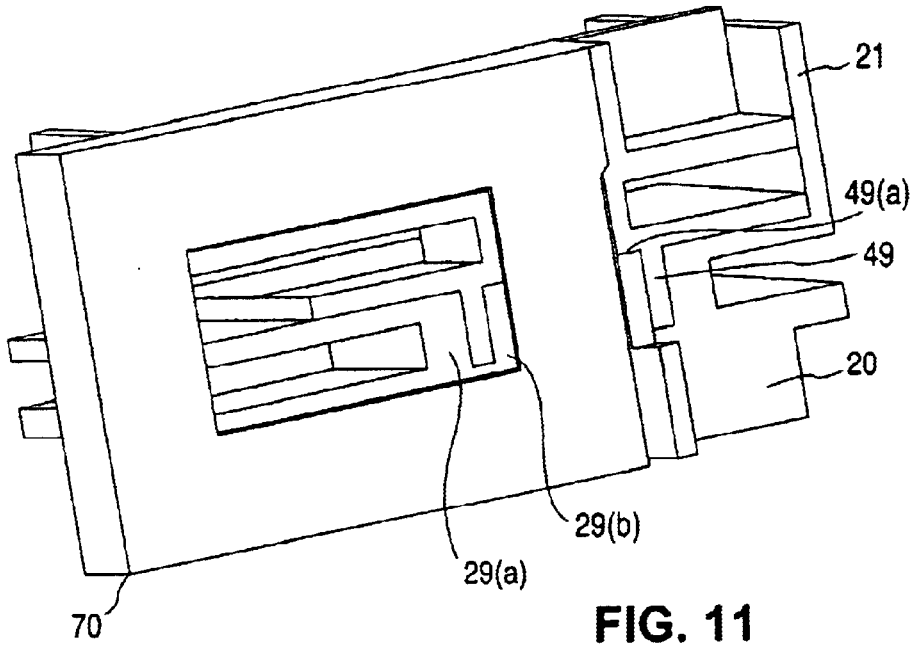
FIG. 11 is a cross-sectional perspective view of a transformer according to an embodiment of the invention.

As noted above, portions of the first and second bobbin members 40, 20 may be cooperatively structured so that the first and second bobbin members 40, 20 can be joined together. Exemplary cooperative structures are shown in FIGS. 10 and 11. FIGS. 10 and 11 show a first bobbin member 40 and a second bobbin member 20. The second bobbin member 20 includes a second body portion 29 including two sections 29(*a*), 29(*b*) which form a recess. The walls 26, 27 of the second bobbin member 20 are axially spaced from each other (e.g., with respect to the axis 105) and extend away from the second body portion 29 in a radial direction. The first bobbin member 40 includes a first body portion 45 coupled to a pair of walls 46, 47. The walls 46, 47 extend away from the first body portion 45 in a radial direction and are axially spaced from one another. A portion of a ring-shaped core 70 is disposed within hollow regions of the first and second body portions 29, 45, while an opposing portion of the core 70 extends past the outer edges of the walls 26, 27, 46, 47. A flange portion 21(*b*) is on a wall 27 of the second bobbin member 20 and extends away from the other wall 26 of the second bobbin member 20. The flange portion 21(*b*) partially encloses the first bobbin member 40 and the winding (not shown) thereon.

Figure 12:
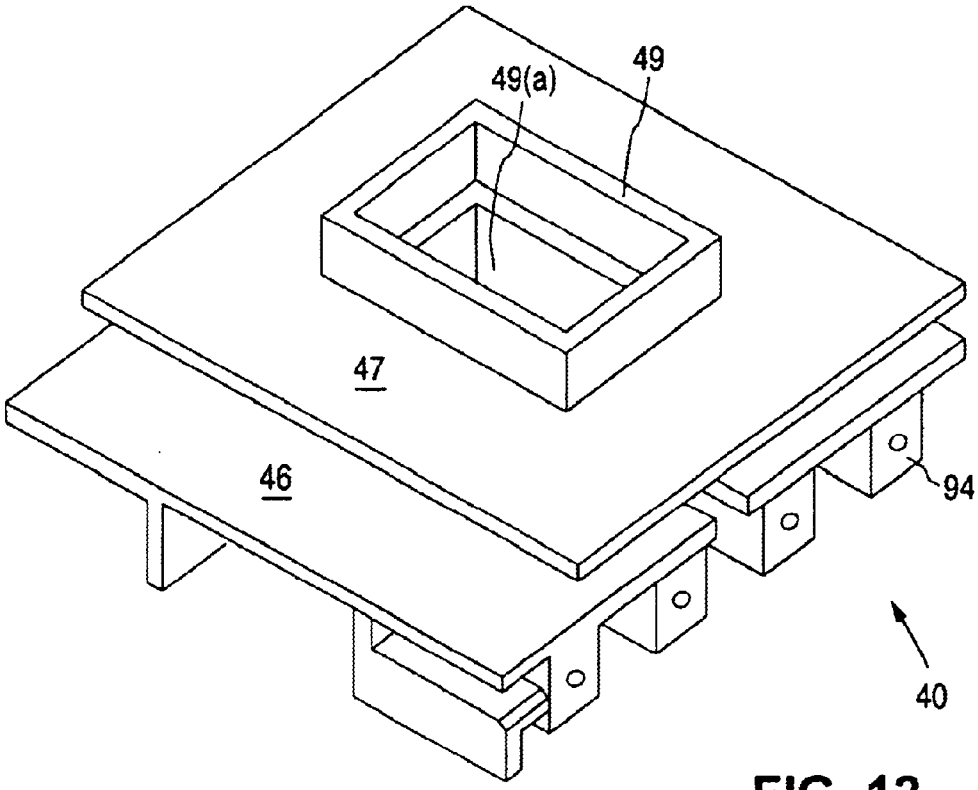
FIGS. 12 and 13 are isometric views of bobbin members according to an embodiment of the invention.
Figure 13:
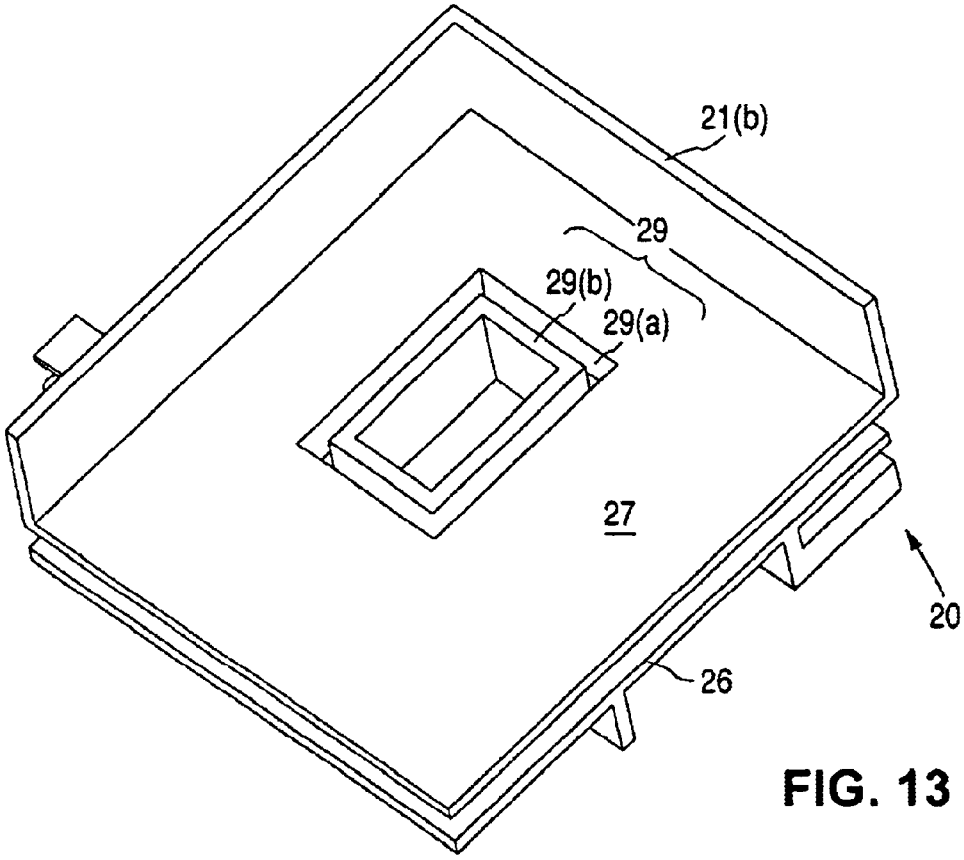

Specific features of the cooperatively structured portions of the first and second bobbin members are more clearly shown in FIGS. 12 and 13. The first bobbin member 40 includes a tubular portion 49 including a ledge 49(*a*). The second bobbin member 20 includes a second body portion 29 with sections 29(*a*), 29(*b*) forming a recess. The recess receives the tubular portion 49 of the first bobbin member 40. When the first and second bobbin members 40, 20 are coupled together, the ledge 49(*a*) can abut an inner section 29(*b*) of the second body portion 29 of the second bobbin member 20.

The cooperatively arranged structures shown in FIGS. 10 to 13 are especially suitable for increasing the creepage distance from, e.g., the core and a conductive layer (e.g., a Faraday shield) disposed between the first and second bobbin members 40, 20. For instance, with reference to FIG. 10, the creepage path between the core portion along the axis 105 and the conductive layer 90 passes from the core 70, down the inner face of the tubular portion 49, up the outer face of the tubular portion 49, and to the conductive layer 90. If, for example, the section 29(*b*) of the second body portion 29 is not present (as in some embodiments), the creepage path would extend from the core 70, up the outer face of the section 29(*a*) of the second body portion 29, and to the conductive layer 90. Accordingly, the embodiments shown and described with reference to FIGS. 10 to 13 are especially desirable to increase the creepage distance between the core and a conductive layer disposed between the bobbin members 20, 40. By doing so, very low profile transformers can be made.

Figure 14:
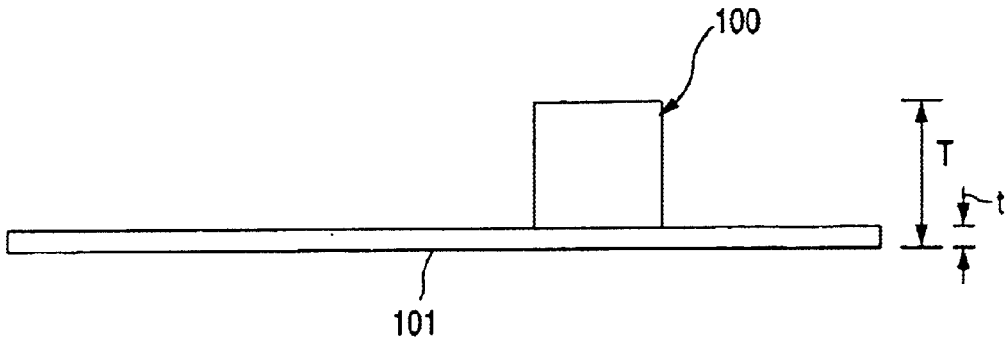
FIG. 14 is a side view of a transformer on top of a circuit board.
Figure 15:
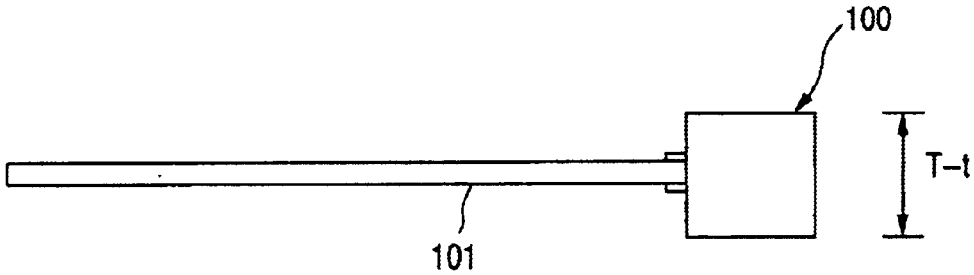
FIG. 15 is a side view of a circuit board coupled to a side of a transformer.

As noted above, embodiments of the invention may also provide for a structure adapted to receive a printed circuit board. The structure is on the side of the transformer and receives the circuit board so that the circuit board is substantially parallel to the walls of the bobbin members of the transformer. In this regard, circuit board receiving structures may be present at any or all of the side surfaces of the first or the second bobbin members. By providing a side mounting structure on the transformer, the overall thickness of a device (e.g., a cellular phone, power supply) using the transformer can be reduced. For example, with reference to FIG. 14, in a typical power supply, a transformer 100 is disposed on a circuit board 101 having a thickness "t". The combined thickness of the circuit board and the transformer 100 is equal to "T". When the circuit board 101 is disposed at the side of the transformer 100 as shown in FIG. 15, the thickness taken up by the circuit board 101 and the transformer 100 is limited to the thickness of the transformer, or "T-t". In embodiments of the invention, the thickness of the power supply can be reduced by the thickness of the circuit board in comparison to many conventional power supplies. More particularly, in embodiments of the invention, the height of the power supply (i.e., printed circuit board, transformer, and other components) can be limited to the height of the transformer.

Figure 16:
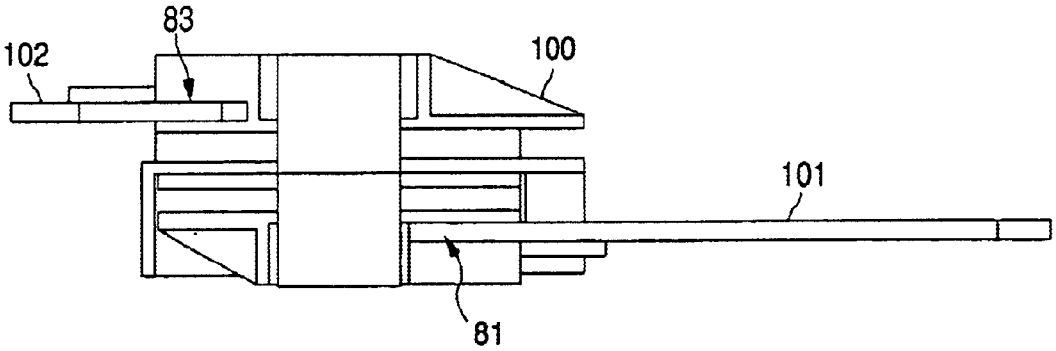
FIG. 16 is a side view of a transformer disposed between two circuit boards.

Providing side mounting structures on a transformer can provide other advantages. For example, with reference to FIGS. 16 and 17, two circuit boards 101, 102 are disposed on opposite sides of a transformer 100. The circuit boards 101, 102 may be within their own respective planes and parallel to each other, or they may be within the same plane. Circuits are not disposed above or below the transformer. Greater isolation is provided between the windings in the transformer 100, thus reducing noise.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed. Moreover, any one or more features of any embodiment of the invention may be combined with any one or more other features of any other embodiment of the invention, without departing from the scope of the invention.

What is claimed is:

1. A transformer having at least one primary winding and one secondary winding wound about a common axis comprising:

a first bobbin member including a first body portion defining a first hollow region, axially spaced walls extending radially away from the first body portion, and a first structure adapted to receive a first printed circuit board (PCB) so that the first printed circuit board is disposed parallel to the walls of the first bobbin member and perpendicular to the common axis; and a second bobbin member including a second body portion defining a second hollow region which is aligned with the first hollow region, axially spaced walls extending radially away from the second body portion, and a second structure adapted to receive a second printed circuit board (PCB) so that the second printed circuit board is disposed parallel to the walls of the second bobbin member and perpendicular to the common axis; and wherein the first bobbin member is disposed adjacent to the second bobbin member, the primary and secondary windings respectively wound about said first and second body portions; and wherein the first and second structures are offset such that the first PCB and second PCB are on different planes so as to provide additional creepage distance between the primary and secondary windings.

* * * * *